US006082689A

United States Patent [19]

Bushway

[11] Patent Number: 6,082,689

[45] Date of Patent: Jul. 4, 2000

[54] ROOF STAGING BRACKET

[75] Inventor: Stephen Bushway, Cummington, Mass.

[73] Assignee: Stephen W. Bushway, Plainfield, Mass.

[21] Appl. No.: 08/511,964

[22] Filed: Aug. 7, 1995

[51] Int. Cl.[7] ..... E04G 1/36

[52] U.S. Cl. ..... 248/237; 182/45; 248/148; 248/291.1

[58] Field of Search ..... 248/237, 291.1, 248/148; 182/45

[56] References Cited

U.S. PATENT DOCUMENTS

| | | | |
|---|---|---|---|
| 1,148,919 | 8/1915 | Nielsen | 248/237 |
| 2,623,794 | 12/1952 | Osten | 248/237 X |
| 2,837,304 | 6/1958 | Goss, Sr. | 248/148 X |
| 4,458,783 | 7/1984 | Stakes | 248/237 X |
| 5,193,773 | 3/1993 | Middleton | 248/148 |
| 5,379,859 | 1/1995 | Pigman | 182/45 |

*Primary Examiner*—Ramon O. Ramirez
*Assistant Examiner*—Derek J. Berger

[57] ABSTRACT

Roof staging bracket apparatus that adjustably straddles the ridge of a roof. The bracket comprises a first member and a second member, means for rotatably joining the second member to the bracket, a gusset brace that has positioning means to which the second member attaches in order to allow the second member to attach to the gusset brace at different positions thereon and enable varying the degree of rotation of the second member about the rotatably joining means, and means for securing the second member at a particular degree of rotation to the gusset brace. The first member comprises the gusset brace and at least one of members is adapted for attachment of staging base apparatus thereto.

8 Claims, 6 Drawing Sheets

ROOF STAGING BRACKET

FIELD OF THE INVENTION

The present invention pertains to a roof staging support device. More specifically, the present invention relates to a bracket device that adjustably fits about and straddles a roof's ridge in order to enable securing roof staging on a roof.

BACKGROUND OF THE INVENTION

In perspective, a real problem facing anyone is how to secure staging to a roof without damaging the roof, as well as easily setting up and dismantling staging, and firmly and safely fastening the staging to a roof. Roof staging in operation and practicality is not convenient. It generally requires elaborate setup, and/or dismantling, and securing physically to the roof itself. Securing to the roof usually entails physically fixing to the roof itself, such as by nails or screws. Thus, upon finishing a roof job, the roof thereby requires patching. In fact, on some roofs, i.e. slate roofs, nails or screws cannot even be used.

Consequently, it is an objective of the present invention to enable quick, simple setup and dismantling of roof staging, and enable securing of staging without the need to fix physically the staging to the roof. Moreover, it is an objective of the present invention to enable multiple securing of staging—for example, capability of staging on both sides of a roof. These and still further objectives will become apparent hereinafter.

SUMMARY OF THE INVENTION

The foregoing objectives are realized by providing a device to which staging base apparatus can be attached, wherein the device itself can be clamped against or fitted about opposite sides of a roof's ridge (without the need of being physically fixed to the roof via, such as, nails or screws), and wherein the device is supported by the roof, is easily assembled and dismantled, and enables securing of multiple staging on a roof.

The present invention comprises a bracket device that has a first member and a second member, wherein at least the second member is rotatably joined to the bracket, brace means that braces the members at a particular angle, and means for securing at least the second member to the brace means at a degree of rotation sufficient for the bracket to straddle the roof's ridge in order to clamp or fit the members against opposite sides of a roof's ridge.

The first member comprises a length and the brace means, whereas the second member comprises a length and is rotatably joined to the bracket. The second member rotatably joins at a position of its length to define a length portion between the position rotatably joined and one end. The brace means has positioning means to which the second member's length portion can attach. The positioning means enables securing the second member's length portion to the brace means at different positions thereon, thereby varying the degree of rotation of the second member about the rotatably joining means. Thus, the degree of rotation of at least the second member can be adjusted for the members to clamp against or fit about their respective roof sides.

Preferably, the bracket device is made of metal for strength. The first member comprises the brace means. The brace means comprises dual, arcuate, right triangular-shaped plates respective to opposite sides of the first member's width, wherein one end of the first member comprises the plates' vertical legs, and the plates' hypotenuse are arcuate-shaped. The plates have a plurality of positioning holes (i.e. holes punched or drilled in the plates) through their vertical faces and spaced in an arc therealong. The second member's length portion has an attaching hole that aligns with the different positioning holes of the brace means when swung past the plates. By rotating the second member about the rotatable joint, the second member can be attached to any particular positioning hole (i.e. via a bolt or pin adapted therefor). In this manner, at least one of the members can be rotated to clamp or fit against opposite sides of a roof's ridge.

There are many advantages to the present invention. With the present invention, there is absolutely no need to nail or screw the staging to a roof itself. Rather, the staging is attached via the bracket device, which is then releasably clamped or fitted about the roof's ridge. The brace means not only allows the user to adjust the tightness of the bracket's fit about the roof's ridge (or the tightness of the clamp when utilized in that fashion), and therefore the fastening firmness of the bracket, but also allows the user to adjust the bracket to the incline of a roof's ridge.

Further, it is readily apparent that, not only do the members fit or clamp about opposite sides of the roof's ridge, but the roof's ridge also provides the support for the bracket, thereby removing the need to nail or screw the device to the roof itself. Further, because the bracket device comprises two members fitted on opposite sides of the roof, each member can be utilized for securing staging (generally via staging or nailing base apparatus, such as 2"×8" boards, attached to the bracket's members)—greatly accommodating the convenience of the user and enhancing the utility of the bracket device.

The bracket is easily assembled and/or dismantled. To assemble, it is merely a matter of joining the two members at their common pivot point with a pin or bolt, and then rotatably adjusting the members about the pin or bolt and then locking the second member to the desired positioning hole on the brace means with another bolt. Staging or nailing base apparatus is easily nailed to the ends of each of the members adapted therefor (nail holes). Similarly, dismantling simply requires undoing and removing of the bolts. Once assembled, it is only a matter of fitting the bracket device about the roof's ridge, and adjusting the members' angle to fasten or clamp tightly and/or to set against the roof's opposite sides.

DETAILED DESCRIPTION OF THE INVENTION

Figure 1:
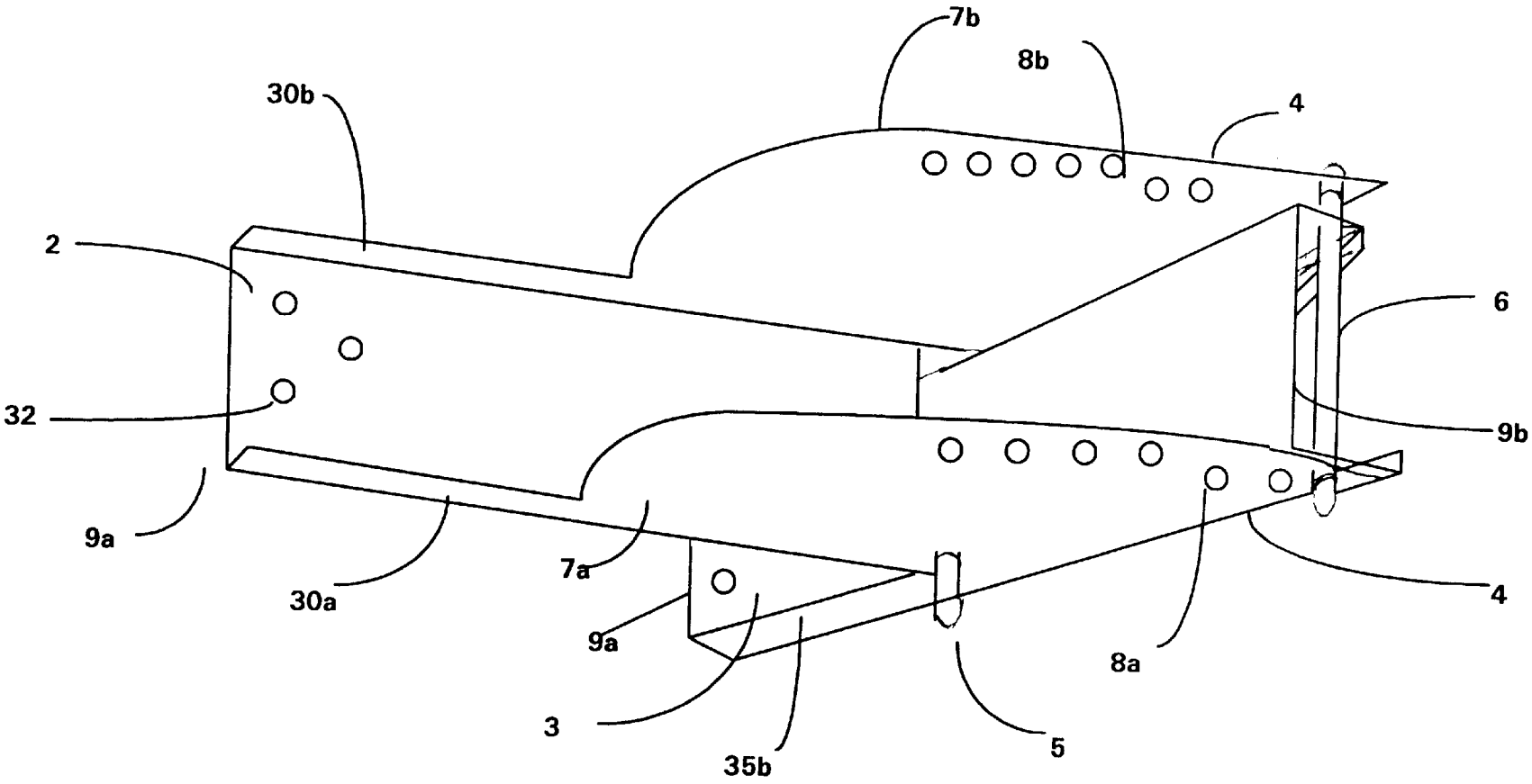
FIG. 1 is a perspective view of one embodiment of the Roof Staging Bracket, wherein the bracket lies upon one of its sides in order to show a perspective of the gusset brace.

An in depth description of the invention and the preferred embodiment is now in order. With reference to the drawings, like reference characters designate like or corresponding parts throughout the several views. It is understood by persons skilled in the art that the Roof Staging Bracket is not restricted to the embodiment shown. Rather, the present embodiment shown is a representative embodiment for purposes of disclosing the preferred embodiment of the present invention and for purposes of explaining the invention.

Figure 2:
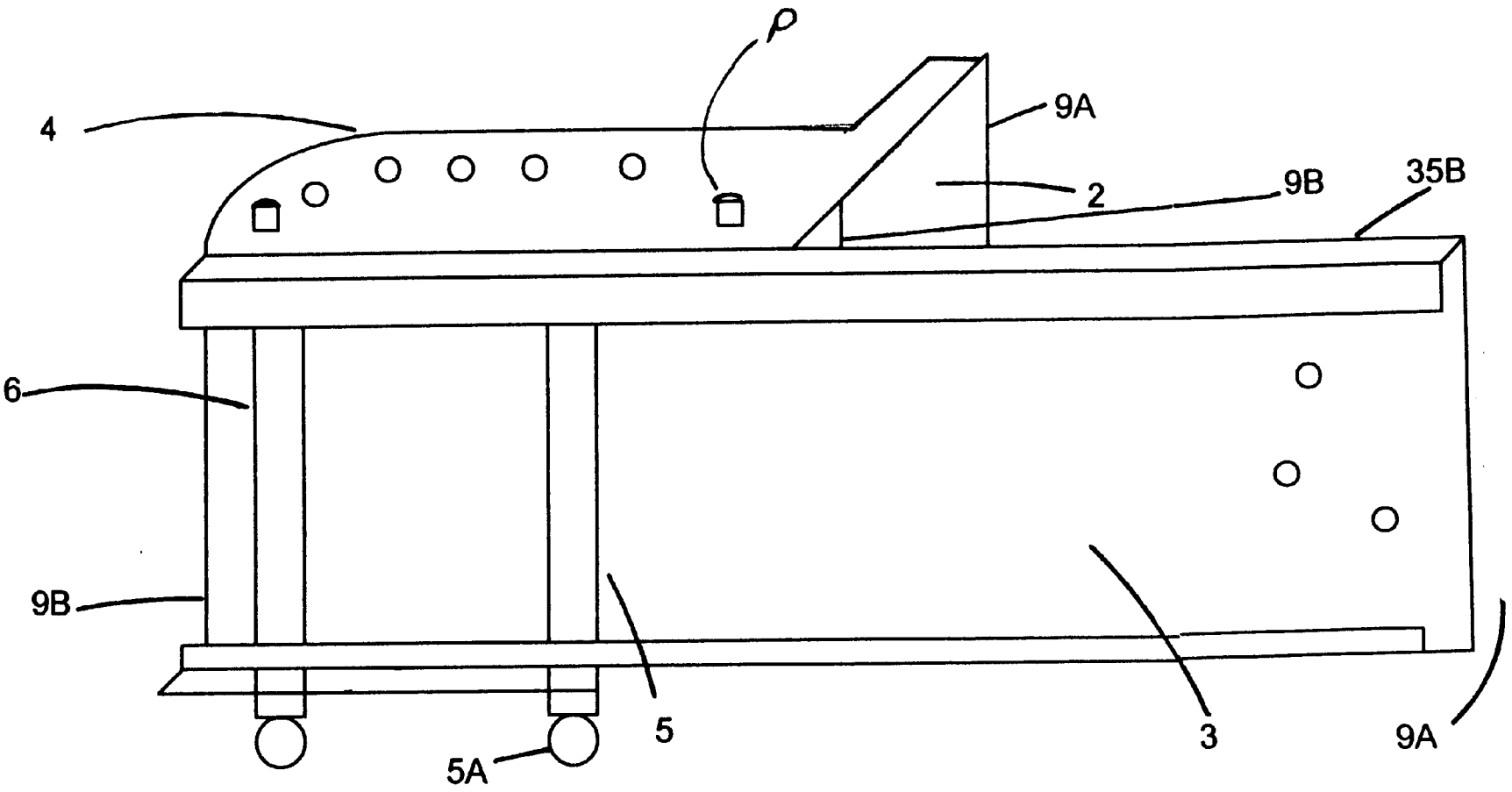
FIG. 2 is a perspective view of one embodiment of the Roof Staging Bracket, wherein the bracket lies upon one of its sides in order to show a perspective of the attachment of the two members at the rotatable joint and attachment of one of the members to the gusset brace.
Figure 3:
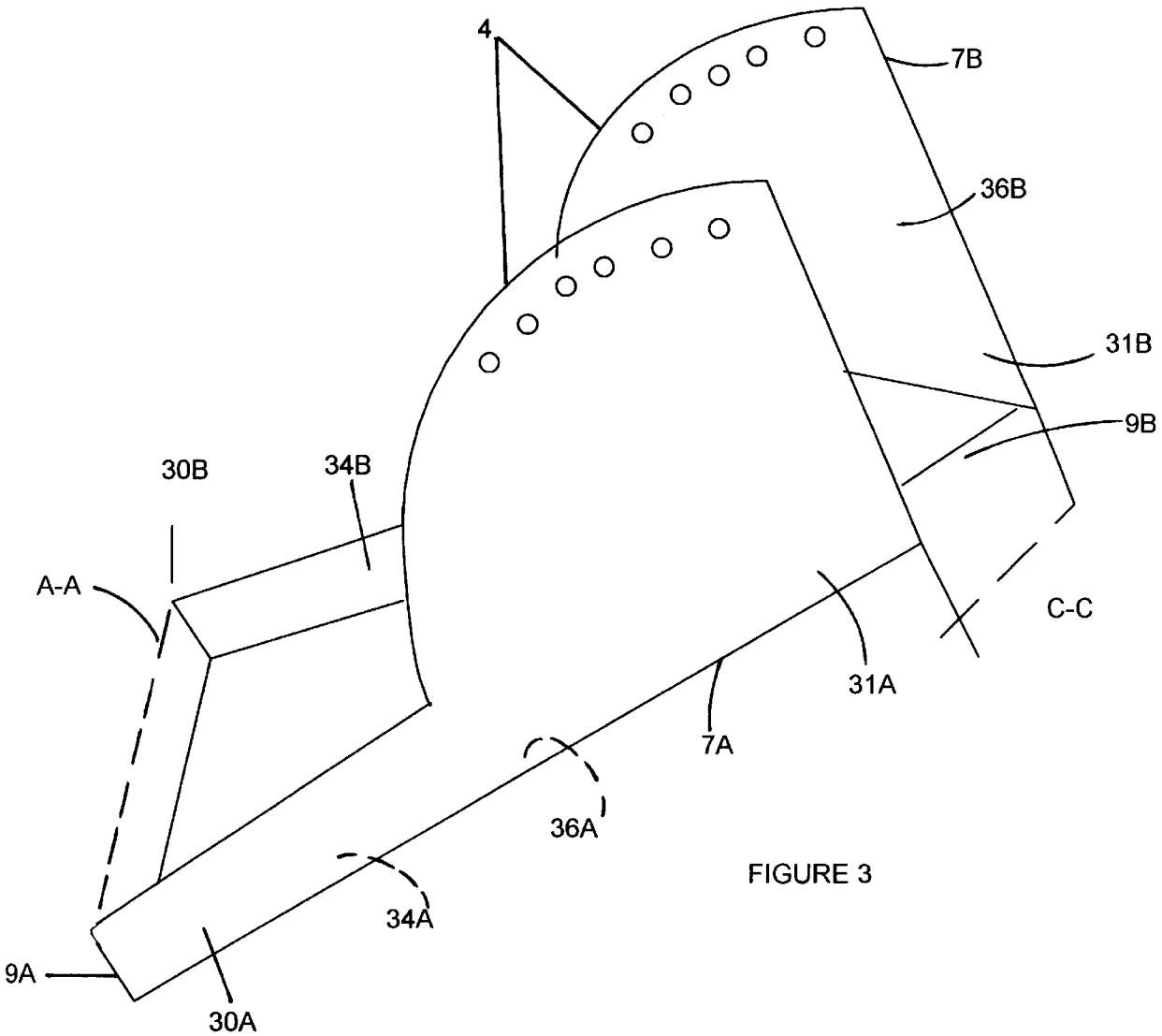
FIG. 3 is a perspective side view of part of the Roof Staging Bracket, wherein the first member and gusset brace are shown.

Referring to FIG. 1 and FIG. 2, bracket device 1 comprises first member 2, second member 3, and rotatable joining means that comprises pivot rod 5 and pivot rod holes 31*a* and 31*b*. First member 2 further comprises the brace means, in this embodiment gusset brace 4. As shown in FIG. 3, gusset brace 4 comprises two arcuate, right triangular-shaped plates 7*a* and 7*b*, which are respective to portions of opposite sides 30*a* and 30*b* of first member 2 and have faces 38*a* and 38*b* respectively, and positioning means for varying the degree of rotation of second member 3. End 9*b* of first member 2 comprises the vertical leg of the triangle (the vertical leg is perpendicular to first member's 2 length), and wherein the hypotenuse of the triangle is arcuate-shaped. The positioning means comprises a plurality of positioning holes 8*a* and 8*b* through plates 7*a* and 7*b*, which are aligned respectively with each other.

Figure 4:
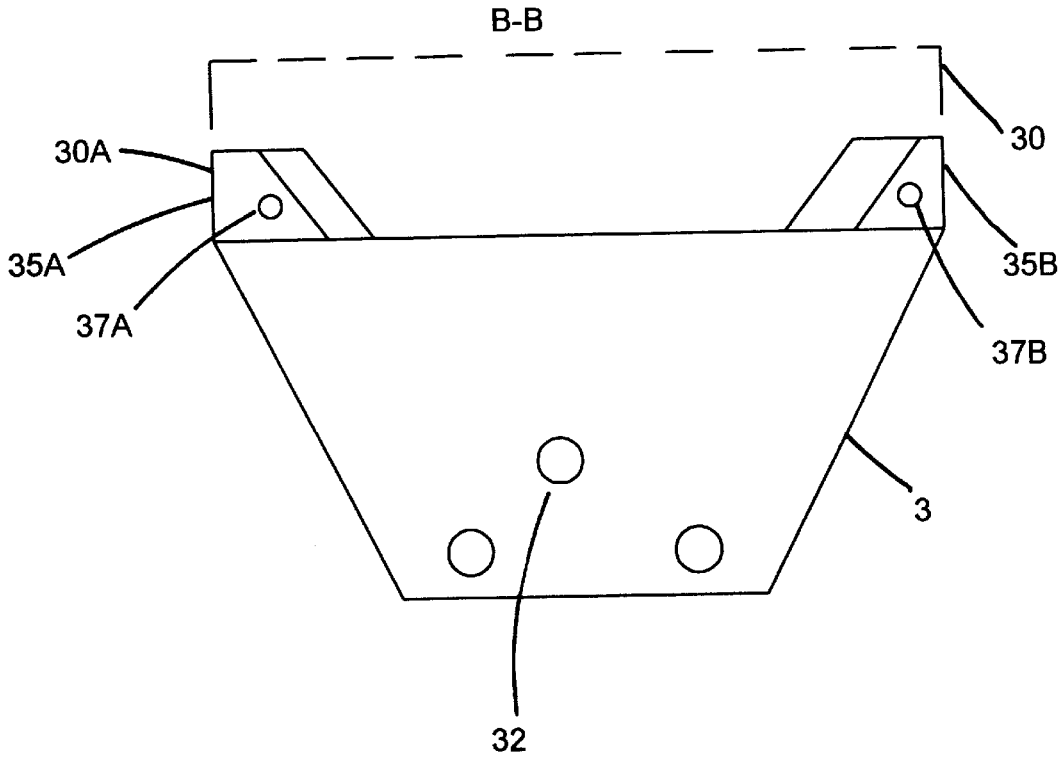
FIG. 4 is a perspective view of part of the Roof Staging Bracket, wherein the second member is shown.
Figure 5:
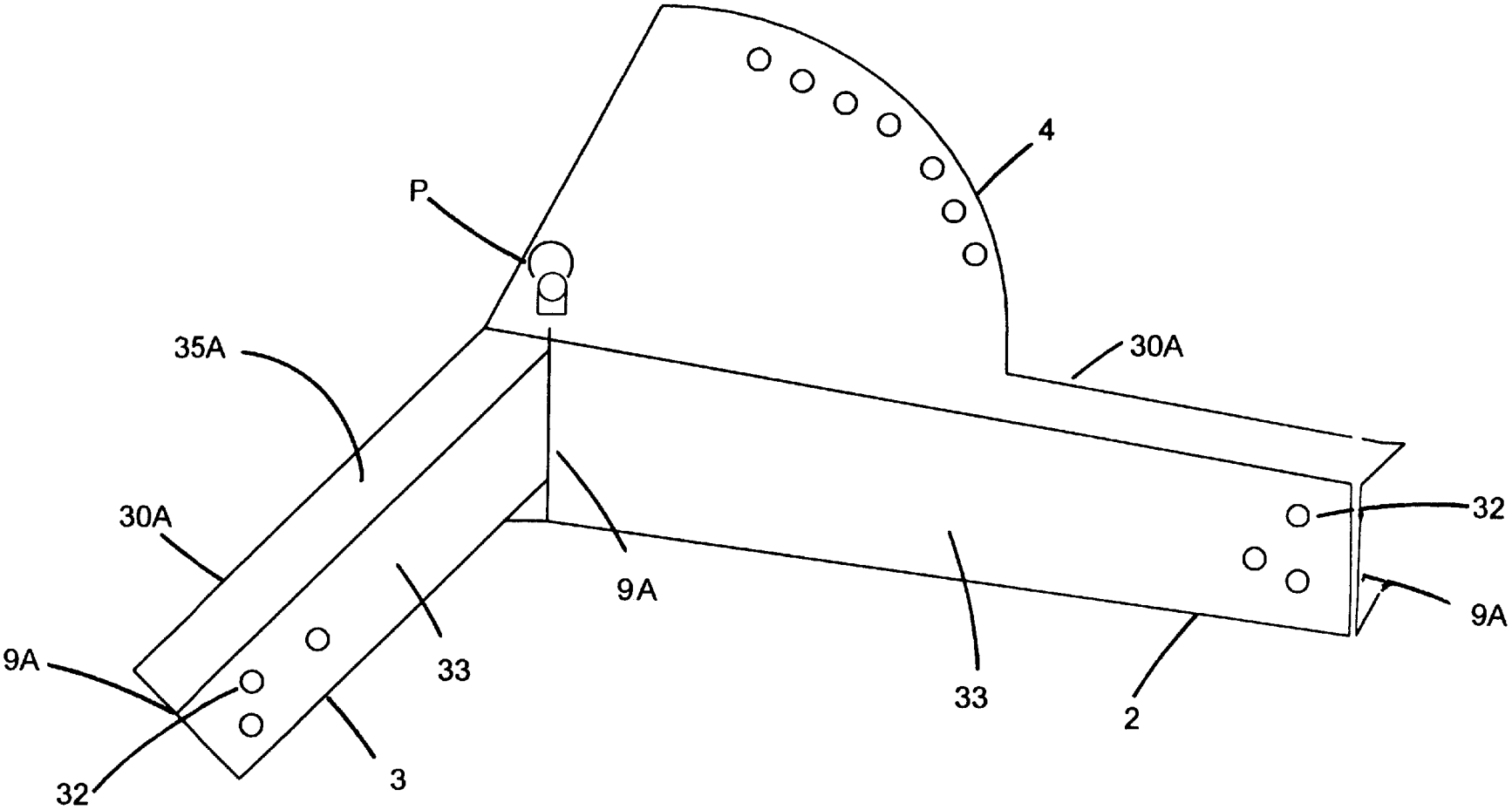
FIG. 5 is a perspective view of one embodiment of the Roof Staging Bracket, wherein the bracket is positioned to show a view of the two members.
Figure 6:
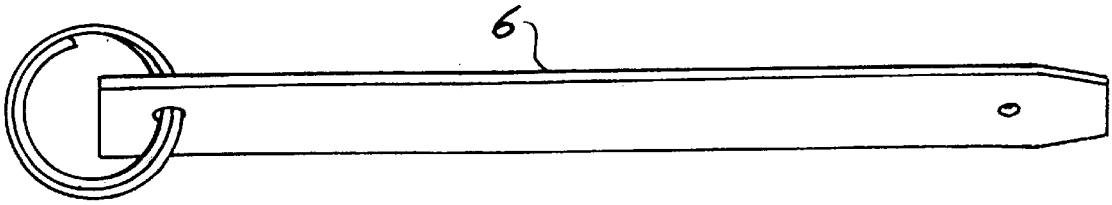
FIG. 6 is a perspective view of a pivot rod and locking clip used in the preferred embodiment to join rotatably the members together.
Figure 7:
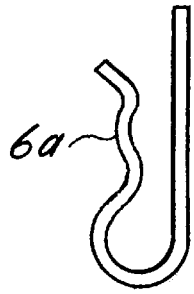
FIG. 7 is a perspective view of a fastening pin and locking clip for securing the second member to the gusset brace.
Figure 7:
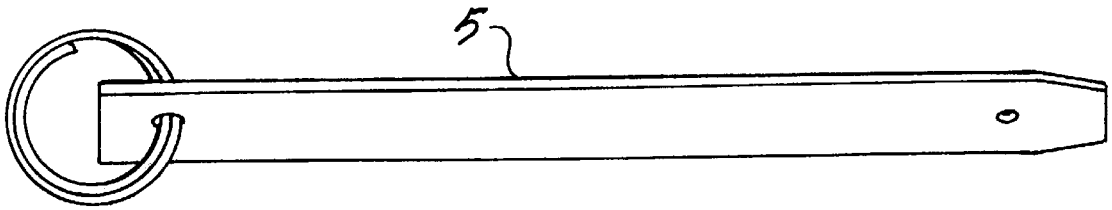
Figure 8:
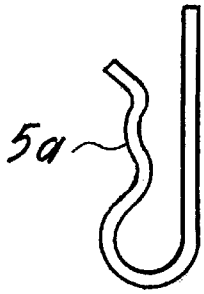
FIG. 8 is a perspective view of a bolt and locking nut for attaching staging or nailing base apparatus (e.g. 2"×8" boards) to the Roof Staging Bracket.
Figure 8:
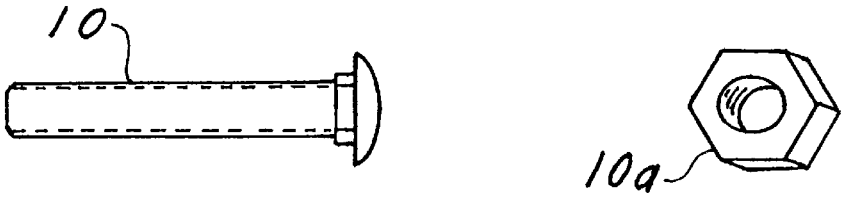

Referring to FIG. 4 and FIG. 5, first and second members 2 and 3 each comprise ends 9*a* and 9*b*, flanged sides 30*a* and 30*b*, pivot rod holes 31*a* and 31*b*, attachment holes 32 to which the staging base can be attached, and bottom surface 33. Pivot rod holes 31*a* and 31*b* align respectively with each other through sides 30*a* and 30*b* and are adapted to receive pivot rod 5 therethrough when aligned. Pivot rod 5 in combination with pivot rod holes 31*a* and 31*b* rotatably join members 2 and 3 together in order to enable members 2 and 3 to rotate about rotatable joint P. Pivot rod holes 31*a* and 31*b* of member 2 are proximate to end 9*b* of first member 2, but pivot rod holes 31*a* and 31*b* of member 3 are spaced from end 9*b* of second member 3.

Width dimension A—A between sides 30*a* and 30*b* of first member 2, as measured from inner faces 34*a* and 34*b* of said sides 30*a* and 30*b*, is greater than width dimension B—B between sides 30*a* and 30*b* of second member 3, as measured from outer faces 35*a* and 35*b* of said sides 30*a* and 30*b*. Second member 3 can therefore fit widthwise between inner faces 34*a* and 34*b* of first member's 2 sides 30*a* and 30*b*, and pivot holes 31*a* and 31*b* of both members 2 and 3 can be aligned with each other in order to fit pivot rod 5 therethrough. Second member's 3 length portion 11 is the length between second member's 3 position rotatably joined, via pivot rod 5 and pivot rod holes 31*a* and 31*b*, and end 9*b* of second member 3.

Referring to FIG. 4, second member 3 also comprises fastening pin attachment holes 37*a* and 37*b*, which align respectively with each other through sides 30*a* and 30*b*. Fastening pin attachment holes 37*a* and 37*b* are positioned proximate to end 9*b* of second member 3. Width dimension C—C between gusset brace's 4 plates 7*a* and 7*b*, as measured from inner faces 36*a* and 36*b* of plates' 7*a* and 7*b*, equals width dimension B—B. Thus, length portion 11 can fit widthwise between inner faces 36*a* and 36*b*. Positioning holes 8*a* and 8*b* and attachment holes 37*a* and 37*b* are aligned with each other wherein, when second member 3 is rotated about rotatable joint P, attachment holes 37*a* and 37*b* align with positioning holes 8*a* and 8*b*. Positioning holes 8*a* and 8*b*, and attachment holes 37*a* and 37*b* are adapted to receive fastening pin 6 therethrough. One manner of enabling such alignment, as in the present embodiment shown, is via spacing positioning holes 8*a* and 8*b* in an arc along the vertical faces 38*a* and 38*b* of plates 7*a* and 7*b* respectively, and positioning attachment holes 37*a* and 37*b* appropriately to align with positioning holes 8*a* and 8*b* when second member 3 is rotated.

Surface portions 33 of each of the members 2 and 3 have sufficient width dimension in order to provide sufficient surface area to set against the respective surface of opposite sides of a roof's ridge and, in the situation when used as a clamp, to enable greater friction for clamping purposes against opposite sides of a roof's ridge.

To assemble the bracket, the user simply fits the outer faces 35*a* and 35*b* of second member's 3 length portion's 11 sides 30*a* and 30*b* between the inner faces 34*a* and 34*b* of first member's 2 sides 30*a* and 30*b*, aligns the respective pivot holes 31*a* and 31*b* of first and second members 2 and 3, fits pivot rod 5 therethrough to lock thereon with locking clip 5*a*. The user then rotates either of the members (or both) to the appropriate incline of the particular roof. The user then aligns locking pin attachment holes 37*a* and 37*b* of second member 3 with the appropriate positioning holes 8*a* and 8*b* of gusset brace 4. Fastening pin 6 is then fitted through fastening pin attachment holes 37*a* and 37*b* and positioning holes 8*a* and 8*b*, and locked thereon with locking clip 6*a*. To dismantle the bracket 1, the user simply unclips clip 5*a* and removes pivot rod 5 from pivot holes 31*a* and 31*b* of members 2 and 3, and unclips clip 6*a* and removes fastening pin 6 from fastening pin attachment holes 37*a* and 37*b* of second member 3 and position holes 8*a* and 8*b* of gusset brace 4.

Two 2×8 wood boards of appropriate lengths comprise the staging base apparatus. Each board length secures to its respective member by fitting the particular board against the respective member, and then bolting, nailing or screwing the board to the respective member via attachment holes 32 of members 2 and 3. Support staging can then be attached to the staging base.

Referring to gusset brace 4 and positioning holes 8*a* and 8*b*, it is understood to those skilled in the art that these means described are merely one type of an embodiment of a brace means and positioning means. Appropriate brace means include a brace, a gusset brace, support, prop, angle member, a frame. A factor of an appropriate positioning means focuses upon enabling the securing of the second member to the brace means at different degrees of rotation about rotatable joint P. Of course, it is readily apparent that the positioning means might comprise spaced holes on the second member itself. In such embodiment, it would be the brace means that fastens to the different spaced holes on the second member when rotated. Consequently, the present invention is not restricted or limited to the particular brace means or positioning means embodiment shown.

While the preferred embodiment of the invention has been disclosed and described, further modifications of the invention herein disclosed will occur to those skilled in the respective art and all such modifications are deemed to be within the scope of the invention as defined by the appended claims.

What is claimed is:

1. Roof staging bracket that fits about the ridge of a roof for securing support staging that comprises:

a first member comprising a top surface, a bottom surface and a length with opposite ends, said top surface of said first member comprising a plate-like brace with a vertical leg perpendicular to said first member's top surface; and a second member comprising a bottom surface and a length with opposite ends;

means for rotatably attaching said first member and said second member to each other at an attachment position of said second member spaced between said second member's ends to define respective clamping segments of each member's length and a brace securing segment of said second member length;

wherein a portion of each bottom surface respective to each member's clamping segment is enabled to fit against a respective side of a roof's ridge when said bracket is fitted thereabout with said second member's attachment position situated over the apex of a roof's ridge to enable said second member's brace securing segment to rotate past said first member's plate-like brace;

wherein at least one of said members is adapted for attachment of staging apparatus thereto; and, means for securing said brace securing segment of said second member's length to said brace at different positions thereon, wherein, upon securing said brace securing segment of said second member's length to said brace, said first member and said second member are fixed at a degree of rotation about said means for rotatably attaching said first member and said second member together.

2. Roof staging bracket as claimed in claim 1, wherein said means for rotatably attaching comprises a pivot hole proximate to an end of said first member and a pivot hole in said attachment position of said second member, alignable with each other, and a rod insertable through said first member's pivot hole and said second member's pivot hole when aligned with each other, and means for locking said rod; and, wherein said means for securing comprises a plurality of spaced positioning holes spaced in an arc along said brace, a securing hole through said brace securing segment of said second member's length that aligns with said plurality of spaced positioning holes when rotated past said brace, and a pin insertable through said securing hole of said brace securing segment of said second member's length and a spaced positioning hole of said brace when aligned with each other, and means for locking said pin.

3. Roof staging bracket as claimed in claim 2, wherein said brace comprises an edge that is aligned with an end of said first member's top surface, said brace's vertical leg comprising said edge.

4. Roof staging bracket as claimed in claim 1, wherein each member has a horizontal width with opposite side walls, wherein the distance of width between said sidewalls of one member is greater than the distance of width between said sidewalls of the other said member to enable interfitting said first member and said second member at said attachment position of said second member;

wherein said means for rotatably attaching comprises a pivot hole through each side wall of said first member proximate to an end of said first member, respectively aligned with each other, and a pivot hole through each sidewall of said second member at said second member's attachment position, respectively aligned with each other, and a pivot rod insertable through said first member's pivot holes and said second member's pivot holes when said members' pivot holes are aligned with each other, and means for locking said rod;

wherein portions of said first member's opposite sidewalls comprise said brace, said sidewall portions comprising opposite sides of said brace, and wherein said means for securing comprises spaced positioning holes on each side of said brace, respectively aligned with each other; and, wherein said means for securing comprises a securing hole through each sidewall of said second member's brace securing segment, respectively aligned with each other, said securing holes alienable with said spaced positioning holes of said brace's opposite sides when said brace securing segment is rotated there past, and a pin insertable through said brace securing segment's securing holes and corresponding spaced positioning holes of said brace's sides when aligned.

5. Roof staging bracket that fits about the ridge of a roof for securing support staging that comprises:

a first member comprising a length with opposite ends and a plate-like brace with a vertical leg perpendicular to said first member's length, and a second member comprising a length with opposite ends;

means for rotatably attaching said first member and said second member to each other at an attachment position of said second member spaced between said second member's ends to define respective clamping segments of each member's length and a brace securing segment of said second member's length;

wherein each member's clamping segment is enabled to fit against a respective side of a roof's ridge when said bracket is fitted thereabout with said second member's attachment position situated over the apex of a roof's ridge to enable said second member's brace securing segment to rotate past said first member's plate-like brace;

wherein at least one of said members is adapted for attachment of staging apparatus thereto; and, means for securing said second member's brace securing segment to said brace at different positions thereon, wherein, upon securing said second member's brace securing segment to said brace, said first member and said second member are fixed at a degree of rotation about said means for rotatably attaching said first member and said second member together.

6. Roof staging bracket as claimed in claim 5, wherein said means for rotatably attaching comprises a pivot hole proximate to an end of said first member and a pivot hole in said attachment position of said second member, alignable with each other, and a rod insertable through said first member's pivot hole and said second member's pivot hole when aligned with each other, and means for locking said rod; and, wherein said means for securing comprises a plurality of spaced positioning holes spaced in an arc along said brace, a securing hole through said brace securing segment of said second member's length that aligns with said plurality of spaced positioning holes when rotated past said brace, and a pin insertable through said securing hole of said brace securing segment of said second member's length and a spaced positioning hole of said brace when aligned with each other, and means for locking said pin.

7. Roof staging bracket as claimed in claim 6, wherein said plate-like brace comprises an edge that is aligned with an end of said first member top surface, said brace's vertical leg comprising said edge.

8. Roof staging bracket as claimed in claim 5, wherein each member has a horizontal width with opposite side walls, wherein the distance of width between said sidewalls of one member is greater than the distance of width between said sidewalls of the other said member to enable interfitting said first member and said second member at said attachment position of said second member;

wherein said means for rotatably attaching comprises a pivot hole through each side wall of said first member proximate to an end of said first member, respectively aligned with each other, and a pivot hole through each sidewall of said second member at said second member's attachment position, respectively aligned with each other, and a pivot rod insertable through said first member's pivot holes and said second member's pivot holes when said members' pivot holes are aligned with each other, and means for locking said rod;

wherein portions of said first member's opposite sidewalls comprise said brace, said sidewall portions comprising opposite sides of said brace, and wherein said means for securing comprises spaced positioning holes on each side of said brace, respectively aligned with each other; and, wherein said means for securing comprises a securing hole through each sidewall of said second member's brace securing segment, respectively aligned with each other, said securing holes alienable with said spaced positioning holes of said brace's opposite sides when said brace securing segment is rotated there past, and a pin insertable through said brace securing segment's securing holes and corresponding spaced positioning holes of said brace's sides when aligned.

* * * * *